US009047848B2

(12) United States Patent
Dyskin

(10) Patent No.: US 9,047,848 B2
(45) Date of Patent: Jun. 2, 2015

(54) THREE STRINGED FRETTED MUSICAL INSTRUMENT

(71) Applicant: Brian Dyskin, Victoria (AU)

(72) Inventor: Brian Dyskin, Victoria (AU)

( * ) Notice: Subject to any disclaimer, the term of this patent is extended or adjusted under 35 U.S.C. 154(b) by 0 days.

(21) Appl. No.: 13/903,192

(22) Filed: Jun. 28, 2013

(65) Prior Publication Data

US 2014/0352518 A1 Dec. 4, 2014

(51) Int. Cl.
*G10D 3/06* (2006.01)

(52) U.S. Cl.
CPC ..... *G10D 3/06* (2013.01)

(58) Field of Classification Search
CPC ..... G10D 3/06
See application file for complete search history.

(56) References Cited

U.S. PATENT DOCUMENTS

| | | | | | |
|---|---|---|---|---|---|
| 3,403,590 | A * | 10/1968 | Quinton | 84/470 R |
| 3,561,314 | A * | 2/1971 | MacEachron | 84/284 |
| 3,758,696 | A * | 9/1973 | Miller | 84/726 |
| 4,126,072 | A * | 11/1978 | Taylor | 84/173 |
| D340,062 | S * | 10/1993 | Magee | D17/14 |
| D408,434 | S * | 4/1999 | Cooley | D17/14 |
| 8,399,756 | B1 * | 3/2013 | Trent et al. | 84/485 R |
| 8,664,502 | B2 * | 3/2014 | Kellner | 84/477 R |
| 2009/0266223 | A1 * | 10/2009 | Tashima | 84/485 R |
| 2014/0352518 | A1 * | 12/2014 | Dyskin | 84/314 N |

OTHER PUBLICATIONS

Doug Berch, Dulcimer Playing With Extra Frets, Jan. 17, 2009, viewed Oct. 21, 2014 at http://dougberch.com/dulcimer-playing-with-extra-frets/.*

Everything Dulcimer, If 1+ Fret is Useful, Is 8+ Fret Also a Must?, post dated Aug. 1, 2011, viewed at http://everythingdulcimer.com/discuss/viewtopic.php?f=2&t=27059 [Oct. 31, 2014 10:16:20 AM].*

* cited by examiner

*Primary Examiner* — Robert W Horn
(74) *Attorney, Agent, or Firm* — Cislo & Thomas, LLP; Kelly W. Cunningham

(57) ABSTRACT

The disclosed musical instrument is a fretted musical instrument with three strings wherein the fretboard has frets (1) installed at positions corresponding to notes of a diatonic scale with the addition of frets at positions corresponding to 10 semitones from the nut and 15 semitones from the nut, and visual fret line markers at all other semitone positions (3). The fretboard is marked with fret position markers (7) according to the musical interval from the nut (2), rather than the actual number of frets from the nut.

8 Claims, 2 Drawing Sheets

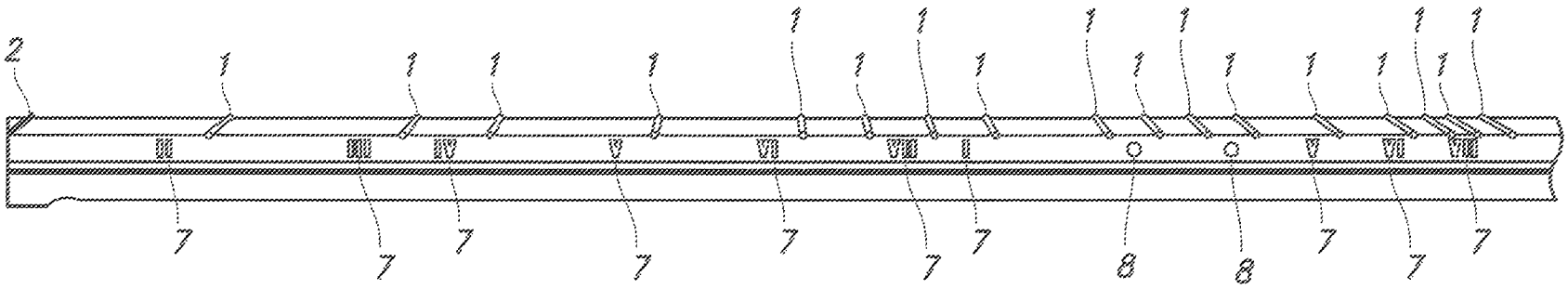
1
1
1

THREE STRINGED FRETTED MUSICAL INSTRUMENT

BACKGROUND OF THE INVENTION

Different stringed fretted instruments have been used over the years to learn and play music. Some, like the diatonically fretted dulcimer are easier to play, but are limited in the musical scales that can be played, while others like the guitar are more difficult to play while they offer the option of playing all musical scales.

SUMMARY OF THE INVENTION

The invention consists of a stringed musical instrument with a neck and a body with three strings or courses of strings, where the middle string is tuned a perfect fifth (7 semitones) above the bass string, and the treble string is tuned to an octave above the bass string.

BRIEF DESCRIPTION OF THE DRAWINGS

FIG. 2 is an elevation of the bass (top) edge of the neck, showing the fretboard side markings and labelling of the fret positions.

DESCRIPTION OF THE PREFERRED EMBODIMENTS

Figure 1:
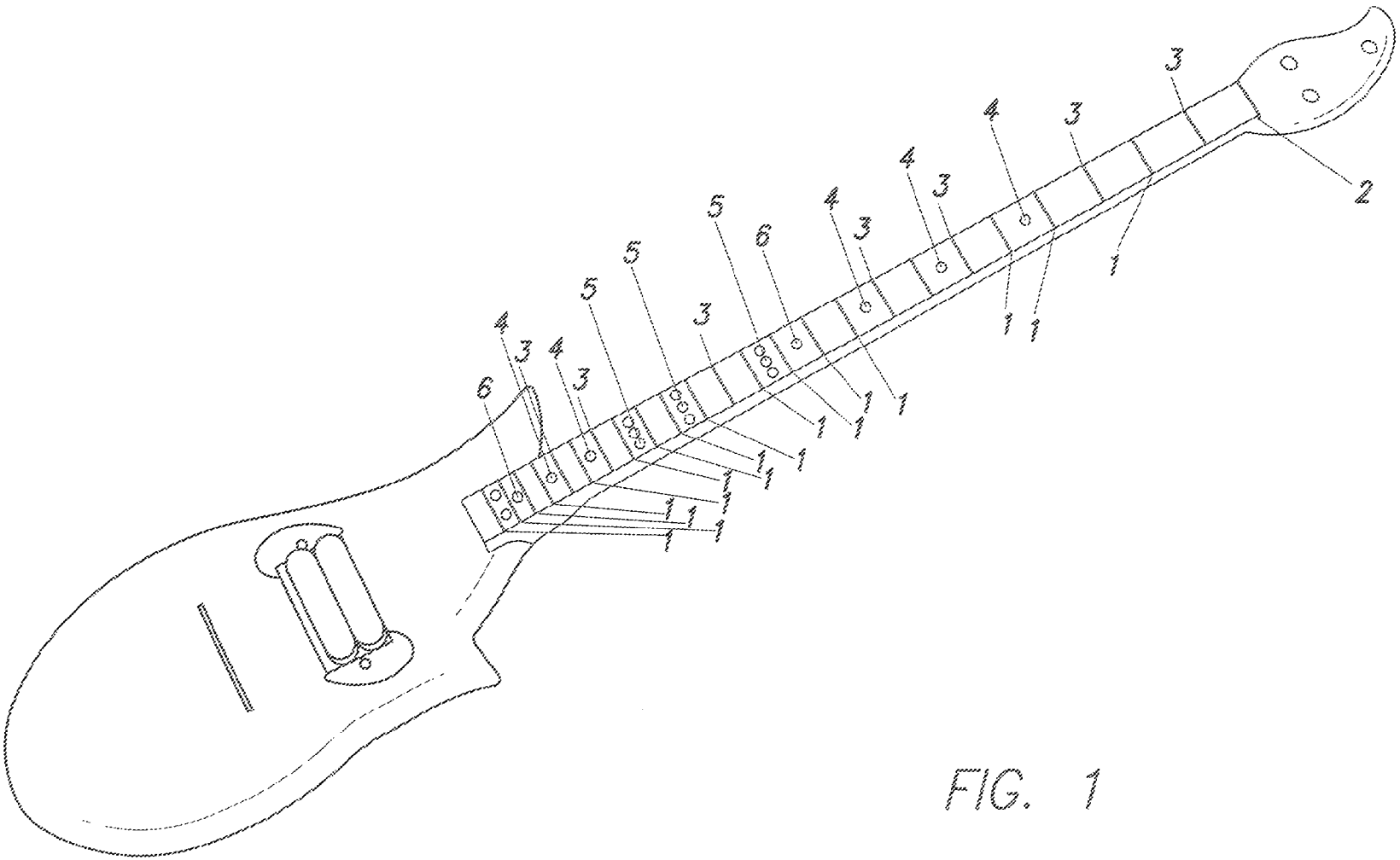
FIG. 1 is a front elevation of the three stringed instrument without the strings to view the fretboard.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

This invention has been devised with unique fretting pattern and neck markings to allow the ease of playing afforded by the dulcimer, allow easy playing of the pentatonic minor scale which is important in rock-and-roll and blues music, and to further improve the ease of playing and learning music on the instrument.

The invention consists of a stringed musical instrument with a neck and a body with three strings or courses of strings, where the middle string is tuned a perfect fifth (7 semitones) above the bass string, and the treble string is tuned to an octave above the bass string.

An instrument in accordance with this invention has divisions spaced according to the chosen scale length which divide the fretboard into semitones steps in the same way that a guitar fretboard is divided by frets. Unlike the guitar, the instrument described does not have frets corresponding to the positions of the first, third, sixth, eighth, thirteenth semitones higher than the open played string. While this is similar to the fret configuration of a dulcimer, this invention includes a fret at the position of the fifteenth semitone which allows for playing the pentatonic minor scale.

Fretboard divisions which do not have frets are marked with lines to visually represent the semitone divisions. Fret positions are marked on the fretboard face for the most common intervals for chords in modern music, i.e. the IV, V, VI intervals of the major scale. Frets are labelled according to the musical interval and markings on the side of the fretboard reflect this labelling in the first octave of the fretboard. In the second octave of the fretboard, markings on the side of the fretboard include specific marks for the frets on which the pentatonic minor scale can be played.

Frets (1) are installed at positions corresponding to 2, 4, 5, 7, 9, 10, 11, 12, 14, 15, 16, 17 semitones from the nut (2) and in the preferred embodiment also 19, 21, 22, 23 and 24 semitones from the nut.

Fret marker lines (3) are present at all other semitone positions.

In the preferred embodiment, markers on the fretboard (4) are present indicating the positions corresponding to the IVth, Vth, and VIth intervals from the open string i.e. 5th, 7th, 9th semitone positions, and optionally at the 19th, 21st and 24th semitone positions.

In the preferred embodiment, different markers (5) are present on the fretboard indicating the notes of the pentatonic minor scale in the second octave—i.e. the 12th, 15th, 17th semitone positions.

In the preferred embodiment, the position of the 11th and 23rd semitones in the middle of the string are marked with a blue marker (6) indicating the flattened fifth note of the scale which, when added to the pentatonic minor scale, makes the blues scale.

In the first octave, position side markers are labelled according to the musical interval from the open played string (7), and in the second octave include specific markings for notes of the pentatonic minor scale (8). In the preferred embodiment of the instrument, intervals are labelled by Roman numerals, including the 12th semitone which is also marks a fret with notes included in the minor pentatonic scale.

While the present invention has been described with regards to particular embodiments, it is recognized that additional variations of the present invention may be devised without departing from the inventive concept.

What is claimed is:

1. A stringed musical instrument comprising, frets installed on the fretboard at positions corresponding to 2, 4, 5, 7, 9, 10, 11, 12, 14, 16, and 17 semitones from the nut of the instrument, and a fret corresponding to the 15th semitone from the nut to allow ease of playing a pentatonic minor scale important in rock-and-roll and blues music wherein visual line markers, flush with or below the fretboard surface, parallel to the frets mark the semitone positions which do not have a fret installed to further improve the ease of playing and learning music on the instrument.

2. The musical instrument of claim 1 wherein fret position markers are labeled according to the musical interval from nut.

3. The musical instrument of claim 2 with additional frets at positions corresponding to 19, 21, 22, 23 and 24 semitones from the nut.

4. A musical instrument as described in claim 1 with additional frets at positions corresponding to 19, 21, 22, 23 and 24 semitones from the nut.

5. A method for playing a stringed musical instrument comprising, providing a stringed musical instrument having frets installed on the fretboard at positions corresponding to 2, 4, 5, 7, 9, 10, 11, 12, 14, 16, and 17 semitones from the nut of the instrument, and a fret corresponding to the 15th semitone from the nut to allow ease of playing a pentatonic minor scale important in rock-and-roll and blues music; and playing said musical instrument;

wherein the musical instrument has visual line markers, flush with or below the fretboard surface, parallel to the frets mark the semitone positions which do not have a fret installed to further improve the ease of playing and learning music on the instrument.

6. The method of claim 5 wherein the musical instrument has fret position markers are labeled according to the musical interval from nut to further improve the ease of playing and learning music on the instrument.

7. The method of claim 6 wherein the musical instrument has with additional frets at positions corresponding to 19, 21, 22, 23 and 24 semitones from the nut.

8. The method of claim 5 wherein the musical instrument has additional frets at positions corresponding to 19, 21, 22, 23 and 24 semitones from the nut.

* * * * *